US008100065B2

(12) United States Patent
Liu et al.

(10) Patent No.: US 8,100,065 B2
(45) Date of Patent: Jan. 24, 2012

(54) FLUE DUST DISCHARGING METHOD AND SYSTEM

(75) Inventors: Shih-Hsien Liu, Kaohsiung County (TW); Ting Fu, Kaohsiung (TW)

(73) Assignee: China Steel Corporation, Kaohsiung (TW)

( * ) Notice: Subject to any disclaimer, the term of this patent is extended or adjusted under 35 U.S.C. 154(b) by 795 days.

(21) Appl. No.: 12/132,991

(22) Filed: Jun. 4, 2008

(65) Prior Publication Data

US 2009/0301362 A1 Dec. 10, 2009

(51) Int. Cl.
*C21B 7/22* (2006.01)
*C21C 5/40* (2006.01)
*F23J 3/00* (2006.01)

(52) U.S. Cl. ..... 110/216; 110/203; 110/217; 266/144; 266/157; 75/468

(58) Field of Classification Search ..... 266/144–159; 75/10.36, 10.37, 10.38, 468; 110/203, 216–217
See application file for complete search history.

(56) References Cited

U.S. PATENT DOCUMENTS 3,948,644 A * 4/1976 Maurice et al. ..... 75/538
2003/0075085 A1 * 4/2003 Kroemmer et al. ..... 110/169

* cited by examiner

*Primary Examiner* — Roy King
*Assistant Examiner* — Lois Zheng
(74) *Attorney, Agent, or Firm* — Finnegan, Henderson, Farabow, Garrett & Dunner, L.L.P.

(57) ABSTRACT

A dust discharging system for a blast furnace includes a dust collector for collecting flue dust from flue gas produced from the blast furnace, a first discharge conduit connected to the dust collector, a separator connected to the first discharge conduit for separating residual flue gas present in the flue dust, and an airtight tank disposed below the first discharge conduit to receive the flue dust in a dry state separated from the residual flue gas.

10 Claims, 5 Drawing Sheets

FLUE DUST DISCHARGING METHOD AND SYSTEM

BACKGROUND OF THE INVENTION

1. Field of the Invention

This invention relates to a dust discharging method and system, more particularly to a flue dust discharging method and system for a blast furnace that can prevent escape of flue gas into the atmosphere and that can minimize the cost of recycling the flue dust.

2. Description of the Related Art

Referring to FIG. 1, a conventional flue dust discharging system includes a dust collector 81 which collects flue dust 801 from flue gas produced from a blast furnace (not shown) and which has a discharge opening 811, a discharge conduit 82 connected to and disposed below the dust collector 81 and communicated with the discharge opening 811, an upper gate valve 821 and a lower gate valve 822 disposed apart from each other on the discharge conduit 82 to control discharge of the flue dust 801, a damper 823 disposed on the conduit 82 between the upper and lower gate valves 821, 822 to control a discharge speed, a screw conveyor 83 connected to and disposed below the discharge conduit 82 and receiving the flue dust 801 that is associated with residual flue gas 802 and that is discharged from the discharge conduit 82, and a sprinkler 84 to sprinkle water into the screw conveyor 83. The screw conveyor 83 has two rotatable screw rods (not shown), and is connected with a discharge tube 831 for discharging the moistened flue dust 801 therethrough.

When the dry flue dust 801 passes through the discharge conduit 82 and falls into the screw conveyor 83, and a suitable amount of water is sprinkled into the screw conveyor 83, the flue dust 801 is mixed with the water through the screw rods in the screw conveyor 83. The moistened flue dust 801 is then pushed down the discharge tube 831 into an open-type receptacle 851, which is disposed below the discharge tube 831, of a loading truck 85. During discharging, the hazardous residual flue gas 802 is prevented from escaping into the atmosphere by the moistened furnace dust 801 which can act as an obstruction in the screw conveyor 83.

However, during the discharging operation, the typical temperature of the flue dust 801 accumulated in the dust collector 81 is about 150° C., so that when the flue dust 801 is mixed with water in the screw conveyor 83, a large amount of steam is produced. Further, if the moistness of the flue dust 801 is not uniform, when the flue dust 801 is discharged into the open-type receptacle 851 of the loading truck 85, the dry portion of the flue dust 801 may become scattering in air and thereby pollute the environment of the workplace. Moreover, because the receptacle 851 of the loading truck 85 is open, during transport and unloading of the flue dust 801 to a storage area, a large amount of steam escapes and the dry flue dust 801 becomes scattering in air, thereby polluting and damaging the environment of the workplace. The safety of workers is also endangered.

Additionally, many manufacturers recycle the flue dust 801 by subjecting the flue dust 801 to a pelletizing operation, so that the flue dust 801 can be fed into the blast furnace again, there by minimizing the cost of feed material. However, the flue dust 801 must be dry in order to perform pelletizing, and the discharged moistened flue dust 801 of the conventional dust discharging system, which has a moisture content of about 13%, must first undergo a drying operation. Hence, the cost of recycling the flue dust 801 is increased.

SUMMARY OF THE INVENTION

Therefore, the object of the present invention is to provide a dust discharging method and system for a blast furnace that are capable of overcoming the aforementioned drawbacks of the prior art.

According to one aspect of this invention, a dust discharging system for a blast furnace comprises a dust collector for collecting flue dust from flue gas produced from the blast furnace, a first discharge conduit connected to the dust collector, a separator connected to the first discharge conduit for separating residual flue gas present in the flue dust, and an airtight tank disposed below the first discharge conduit to receive the flue dust in a dry state separated from the residual flue gas.

According to another aspect of this invention, a method for discharging flue dust from flue gas produced from a blast furnace comprises the steps of: collecting the flue dust; moving downwardly the flue dust through a first discharge conduit; separating residual flue gas present in the flue dust by allowing the residual flue gas to flow through an exhaust duct which is connected to the first discharge conduit; and discharging the flue dust in a dry state directly into an airtight tank after separating the residual flue gas.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
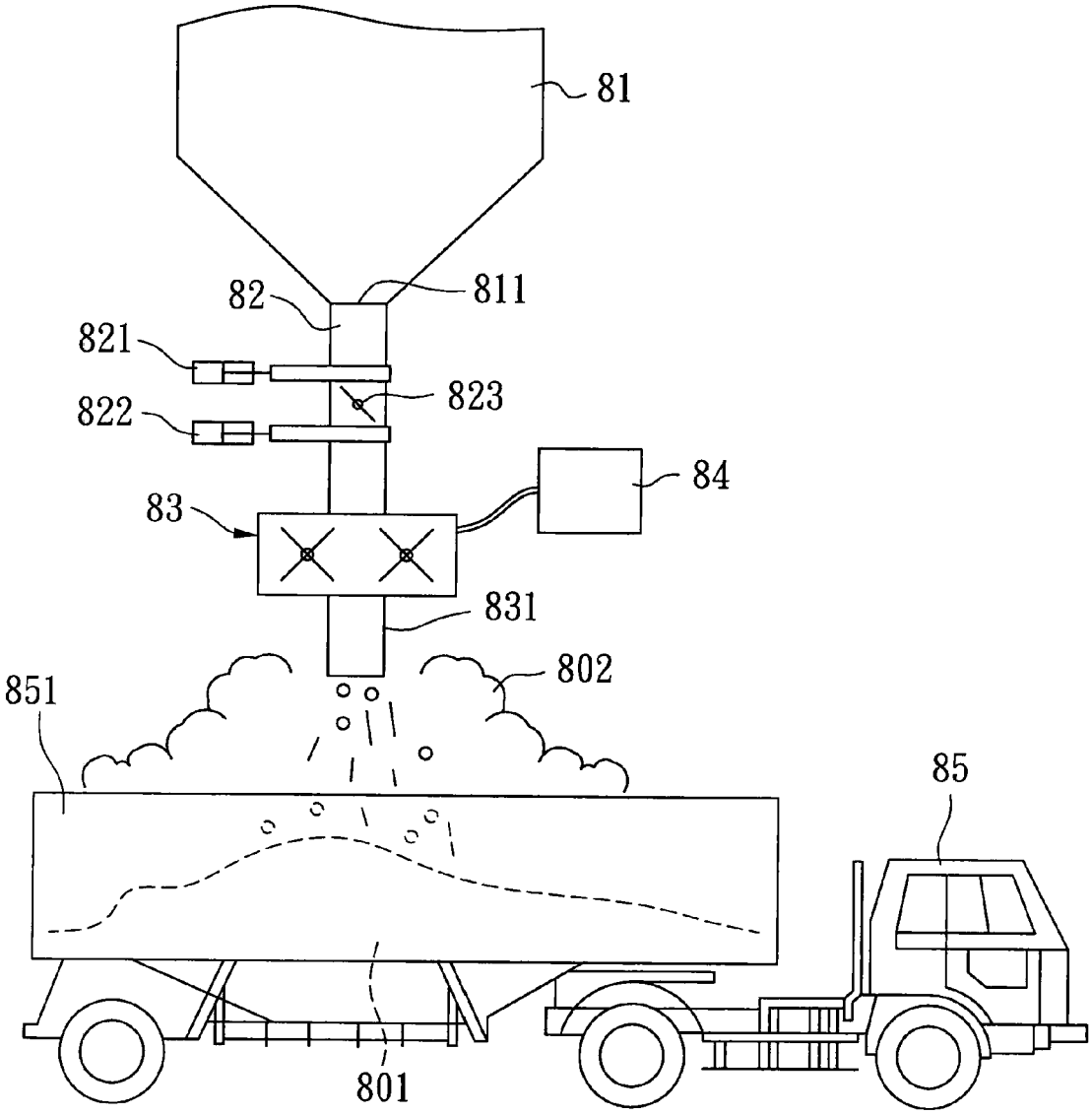
FIG. 1 PRIOR ART
FIG. 1 is a schematic view, illustrating a conventional dust discharging system.

Before the present invention is described in greater detail, it should be noted that the same reference numerals have been used to denote like elements throughout the specification.

Figure 2:
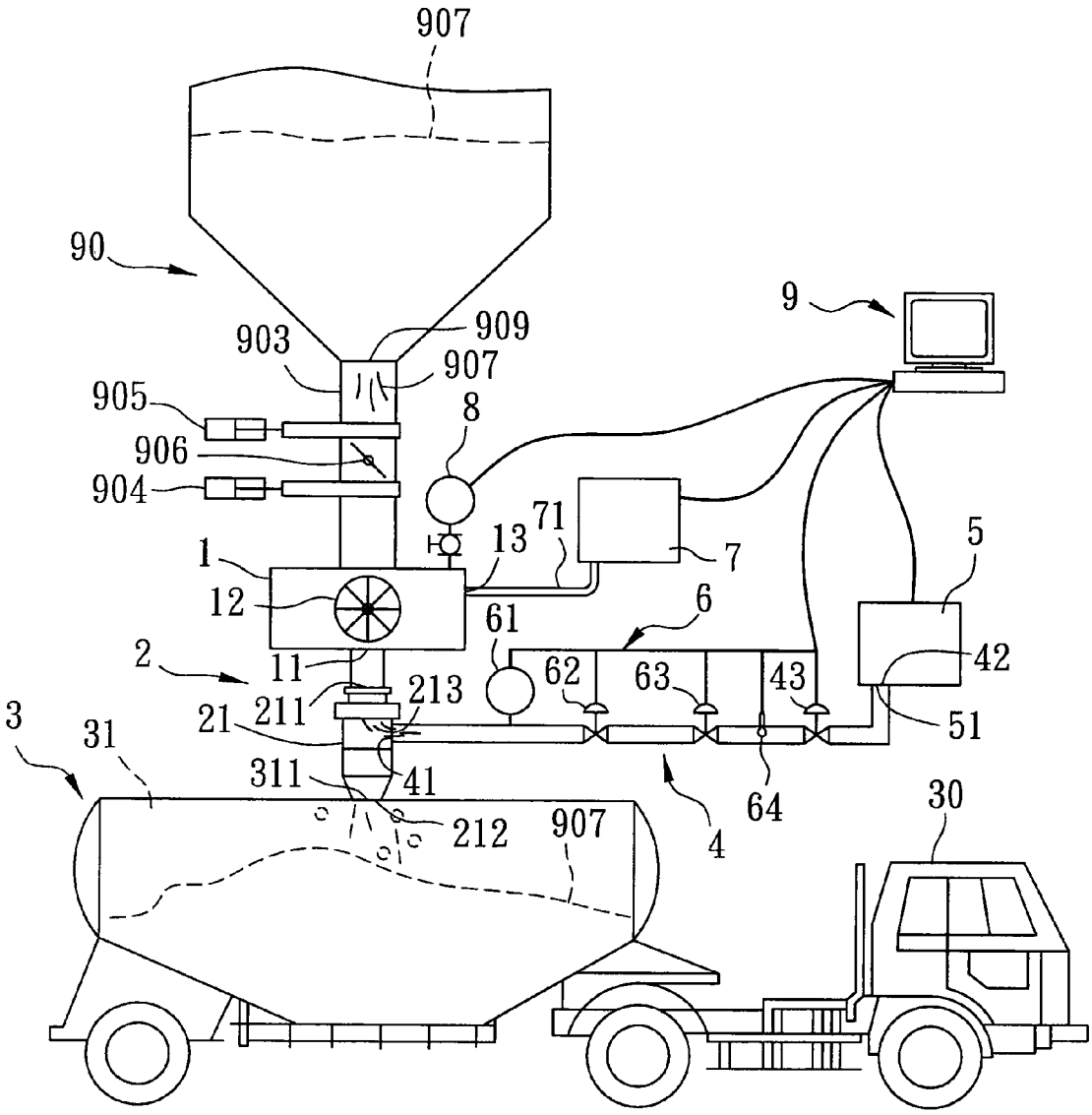
FIG. 2 is a schematic view, illustrating a dust discharging system for a blast furnace according to the first preferred embodiment of the present invention.

Referring to FIG. 2, a dust discharging system according to the first preferred embodiment of the present invention is suitable for treating flue dust 907 from flue gas produced during an operation of a blast furnace (not shown). The dust discharging system comprises the dust collector 90, a first discharge conduit 903, a screw conveyor 1, a separator 2, an airtight tank 3, a control device 6, a nitrogen injecting device 7, a pressure indicator 8, and a central processor 9.

The dust collector 90 collects and stores the flue dust 907 from the flue gas produced from the blast furnace, and has a first discharge opening 909.

The first discharge conduit 903 is connected to and disposed below the dust collector 90, and communicates with the first discharge opening 909. Spaced-apart upper and lower gate valves 905, 904 are connected to the first discharge conduit 903 to control flow of discharge, and a damper 906 is disposed on the first discharge conduit 903 between the upper and lower gate valves 905, 904 to control speed of discharge.

The screw conveyor 1 is airtight, and is connected communicatingly with and is disposed below the first discharge conduit 903 to move the flue dust 907 toward the separator 2. The screw conveyor 1 has a second discharge opening 11 for discharging the flue dust 907 from the first discharge conduit 903, and an electric motor 12 to drive a screw rod (not shown).

The separator 2 includes a second discharge conduit 21, an exhaust duct 4, and an exhaust blower 5. The second discharge conduit 21 is telescopic, and has an entry end 211 connected to the second discharge opening 11 to receive the flue dust 907 discharged therefrom, an exit end 212 opposite to the entry end 211, and an exhaust opening 213 between the entry and exit ends 211, 212. The exhaust duct 4 has a first end 41 connected to the second discharge conduit 21 through the exhaust opening 213 to separate residual flue gas present in the flue dust 907 in the second discharge conduit 21, a second end 42 opposite to the first end 41, and an exhaust valve 43 disposed proximate to the second end 42. The exhaust blower 5 is connected to the second end 42 of the exhaust duct 4 through an opening 51 to draw the residual flue gas away from the flue dust 907. In this embodiment, the exhaust blower 5 is one which is conventionally used in a cast house of a blast furnace in a steel mill to remove the scattering dust and escaping flue gas during tapping liquid iron and slag. Through creation of a large air suction by operation of the exhaust blower 5, the residual carbon monoxide in the flue gas can be diluted so as to reduce the concentration thereof.

The airtight tank 3 defines a receiving space 31 for receiving through an entry port 311 thereof the flue dust 907 in a dry state that is separated from the residual flue gas. The exit end 212 of the second discharge conduit 21 is connected to the entry port 311 in an airtight manner. In this embodiment, the airtight tank 3 is fixed to a vehicle frame of a trailer 30 to facilitate transport of the same.

The control device 6 is connected to the exhaust duct 4 to control and monitor conditions inside the exhaust duct 4 when the residual flue gas passes therethrough, and adjustments are made accordingly to prevent the temperature and flow rate of the residual flue gas from deviating a predetermined values and thereby damaging the exhaust duct 4 and polluting the environment of the workplace. In this embodiment, the control device 6 includes an orifice flow meter 61, a flow regulating valve 62, a shut-off valve 63, and a thermometer 64. When the orifice flow meter 61 detects an abnormal flow of the residual flue gas in the exhaust duct 4, the flow rate of the residual flue gas is adjusted through the flow regulating valve 62. The thermometer 64 is used to measure the temperature inside the exhaust duct 4. If the temperature inside the exhaust duct 4 exceeds or reaches the predetermined temperature, the shut-off valve 63 is used to stop temporarily the flow of the residual flue gas into the exhaust duct 4.

The nitrogen injecting device 7 uses high pressure to supply nitrogen gas into the screw conveyor 1 so as to dilute carbon monoxide concentration of the residual flue gas in the discharging system, so that explosion and ignition that may arise due to high temperature of the residual flue gas and excessive carbon monoxide concentration thereof can be prevented.

Figure 3:
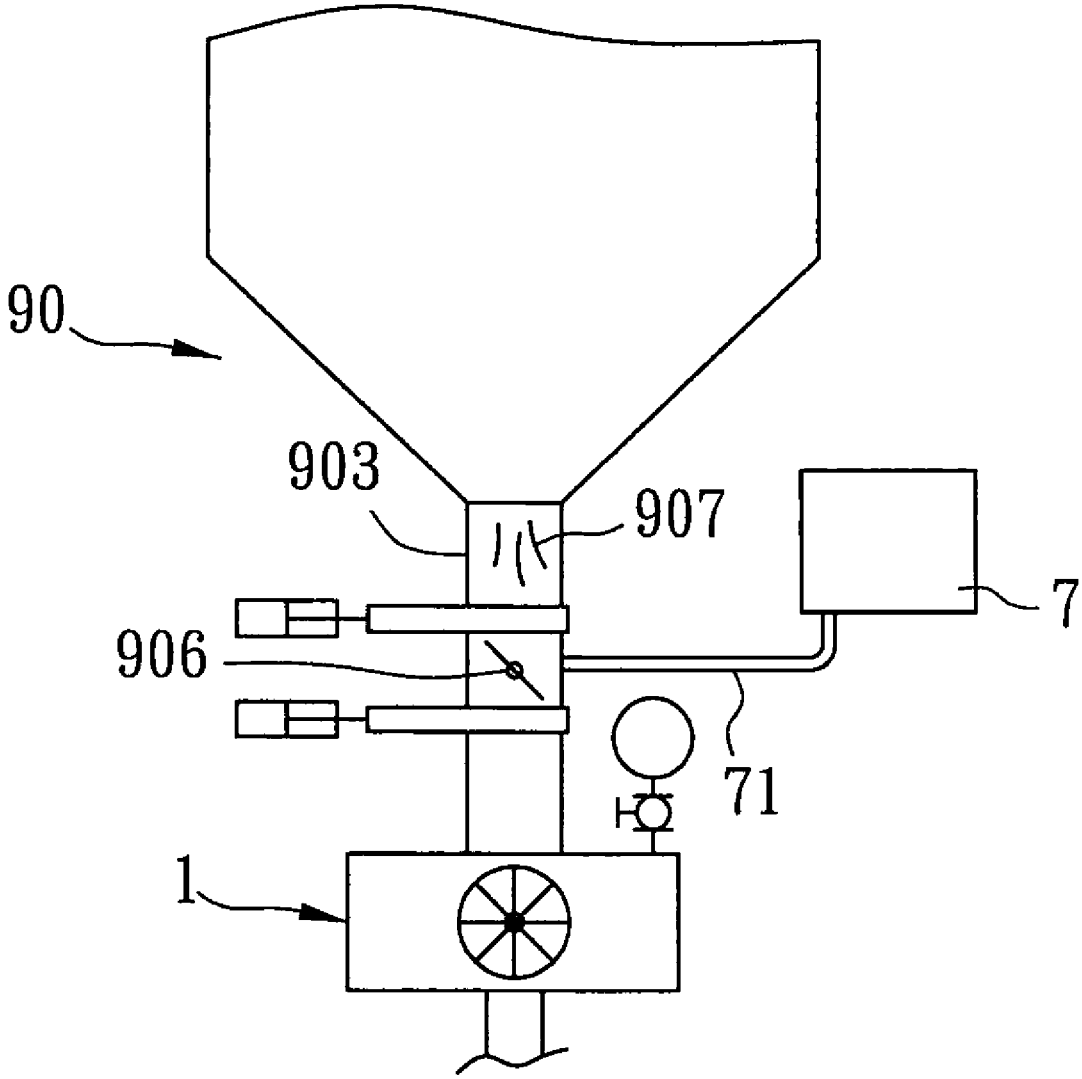
FIG. 3 is a fragmentary schematic view of an alternative form of the first preferred embodiment.

It is worth mentioning that, in this embodiment, the screw conveyor 1 further has a guide hole 13. A pipe 71 of the nitrogen injecting device 7 is connected to the screw conveyor 1 through the guide hole 13 to permit supply of nitrogen gas into the screw conveyor 1. In an alternative embodiment, as shown in FIG. 3, the pipe 71 of the nitrogen injecting device 7 may be connected to the first discharge conduit 903, so that nitrogen gas may be supplied to the first discharge conduit 903 to dilute the carbon monoxide concentration of the residual flue gas in the first discharge conduit 903. Hence, the method of supplying nitrogen gas into the system is not limited to the disclosed embodiment.

The pressure indicator 8 is connected to the screw conveyor 1 to regulate a pressure of the screw conveyor 1 when nitrogen gas is supplied therein, so that excessive pressure inside the screw conveyor 1 can be prevented, and moving of the flue dust 907 from the first discharge conduit 903 can be stopped. Hence, smooth discharge of the flue dust 907 can be ensured.

The central processor 9 is connected electrically to the control device 6, the nitrogen injecting device 7, the pressure indicator 8, the exhaust blower 5, and the electric motor 12 of the screw conveyor 1 so as to monitor conditions of the flue dust 907 moving through the screw conveyor 1 based on the current load of the electric motor 12 and the pressure in the screw conveyor 1 through the pressure indicator 8. As such, appropriate adjustments can be made accordingly.

In this embodiment, the flow regulating valve 62 of the control device 6 is controlled automatically through the central processor 9. However, in operation practice, the flow regulating valve 62 may be controlled manually.

Figure 4:
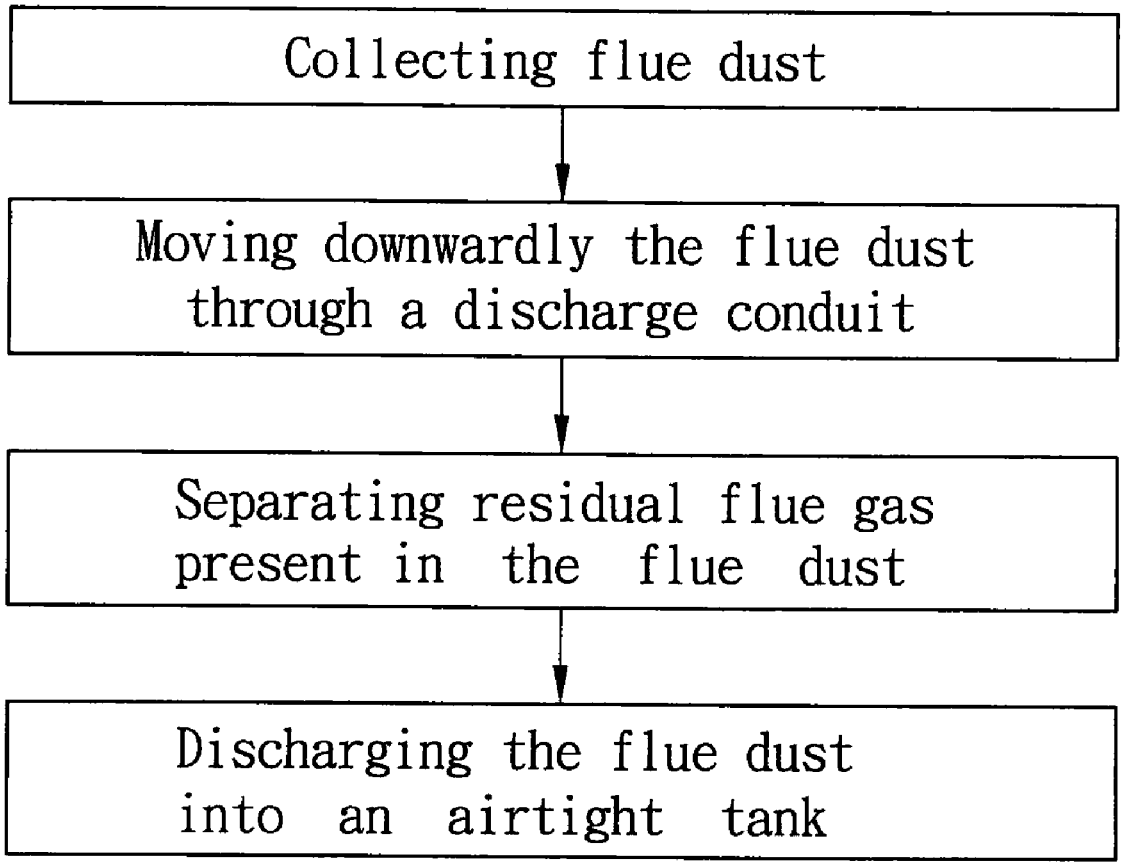
FIG. 4 is a flow chart, illustrating the steps involved in a dust discharging method for a blast furnace according to the first preferred embodiment of the present invention.

Referring to FIG. 4, in combination with FIG. 2, the dust discharging method using the dust discharging system of the first preferred embodiment includes the below steps.

The first step is to collect the flue dust 907 from the flue gas produced from the blast furnace (not shown) through the dust collector 90.

The second step is to move downwardly the flue dust 907 through the first discharge conduit 903 which is connected to the dust collector 90. The screw conveyor 1, which is connected to the first discharge conduit 903 and which has an electric motor 12, is used to move the flue dust 907 downwardly through the first discharge conduit 903.

The third step is to separate residual flue gas present in the flue dust 907 by allowing the residual flue gas to flow through the exhaust duct 4 which is connected to the second discharge conduit 21. An exhaust blower 5, which is connected to the exhaust duct 4, is used to draw the residual flue gas away from the flue dust 907. Prior to separation of the residual flue gas from the flue dust 907, the residual flue gas is first diluted by injecting nitrogen gas either to the screw conveyor 1 or to the first discharge conduit 903.

The fourth step is to discharge the flue dust 907 in a dry state directly into the airtight tank 3 after separating the residual flue gas.

During the first to fourth steps, the condition of the flue dust 907 moving through the screw conveyor 1 is monitored based on the current load of the electric motor 12 and the pressure in the screw conveyor 1 by using the central processor 9.

When the central processor 9 detects that the current load of the electric motor 12 is lower than a normal load value, this means that the flue dust 907 have been substantially completely discharged from the dust collector 90. The upper gate valve 905 is then closed to prevent further discharging of the flue dust 907 from the dust collector 90. Afterwards, the nitrogen injecting device 7, the lower gate valve 904, the electric motor 12, and the exhaust blower 5 are closed or turned off sequentially.

Figure 5:
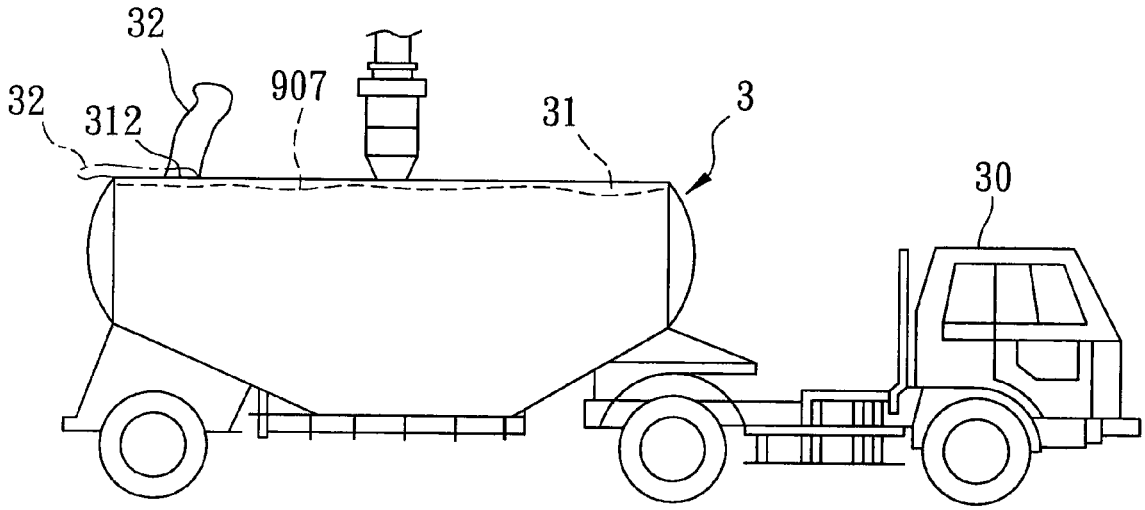
FIG. 5 is a fragmentary schematic view, illustrating a dust discharging system for a blast furnace according to the second preferred embodiment of the present invention.

Referring to FIG. 5, a dust discharging system according to the second preferred embodiment of the present invention is shown to be similar to the first preferred embodiment. However, in this embodiment, the airtight tank 3 further has an air outlet 312 communicating with the receiving space 31, and the dust discharging system further comprises an auxiliary indicator having a gas-filter bag 32 connected fluidly to the airtight tank 3 through the air outlet 312. The gas-filter bag 32 is exposed on the airtight tank 3, and is expandable when the flue dust 907 from the dust collector 90 flows into the airtight tank 3. In particular, when big amount of the flue dust 907 in the dust collector 90 instantly flows into the airtight tank 3, air in the airtight tank 3 will be expelled into the gas-filter bag 32 because the volume of the air is replaced by the volume of the flue dust 907, so that the gas-filter bag 32 expands. The level of expansion of the gas-filter bag 32 can be observed by an operator. When the gas-filter bag 32 expands by a certain amount, this warns the operator that nearly all of the flue dust 907 from the dust collector 90 has been discharged into the airtight tank 3.

A dust discharging method using the second preferred embodiment of the present invention is similar to the first preferred embodiment. However, in this embodiment, aside from using the central processor 9 to determine whether or not the discharge of the flue dust 907 from the dust collector 90 is substantially completed, the operator can also visually observe the degree of expansion of the gas-filter bag 32.

From the aforementioned description, the dust discharging system and method of the present invention make use of the gas-tight connection among the components of the dust discharging system, i.e., the components from the dust collector 90 down to the airtight tank 3, to prevent the flue dust 907 from scattering in air and causing environmental pollution. Because the flue dust 907 is in a dry state all the time during the discharging operation, and there is no need to mix the flue dust 907 with water, there is no presence of hazardous steam, and water is conserved. Moreover, through monitoring of the control device 6, the risk of damage to or explosion of the present invention due to high temperatures may be avoided. Additionally, since the flue dust 907 in the final handling stage remains in a dry state, the flue dust 907 can be directly recycle and need not undergo any drying process as required in the conventional dust discharging system.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

We claim:

1. A dust discharging system for a blast furnace, comprising:

a dust collector for collecting flue dust from flue gas produced from the blast furnace;

a first discharge conduit connected to said dust collector;

a separator connected to said first discharge conduit for separating residual flue gas present in the flue dust; an airtight tank disposed below said first discharge conduit to receive the flue dust in a dry state separated from the residual flue gas; and a screw conveyor connected between said first discharge conduit and said separator to move the flue dust in said first discharge conduit toward said airtight tank.

2. The dust discharging system of claim 1, wherein said separator includes a second discharge conduit connected to said first discharge conduit to receive the flue dust associated with the residual flue gas and falling from said first discharge conduit, an exhaust duct connected to said second discharge conduit to separate the residual flue gas from the flue dust, and an exhaust blower connected to said exhaust duct.

3. The dust discharging system of claim 2, wherein said second discharge conduit is telescopic.

4. The dust discharging system of claim 2, further comprising a nitrogen injecting device for supplying nitrogen gas into said screw conveyor to dilute a concentration of the residual flue gas in said screw conveyor.

5. The dust discharging system of claim 2, further comprising a nitrogen injecting device for supplying nitrogen gas into said first discharging conduit to dilute a concentration of the residual flue gas in said first discharging conduit.

6. The dust discharging system of claim 4, further comprising:

a control device connected to said exhaust duct to control and monitor conditions inside said exhaust duct, said control device including a flow meter, a flow regulating valve, a shut-off valve, and a thermometer.

7. The dust discharging system of claim 6, further comprising:

a pressure indicator connected to said screw conveyor to regulate a pressure in said screw conveyor.

8. The dust discharging system of claim 7, wherein said screw conveyor has an electric motor.

9. The dust discharging system of claim 8, further comprising:

a central processor connected electrically to said control device, said nitrogen injecting device, said pressure indicator, said separator, and said electric motor, said central processor monitoring conditions of the flue dust moving through said screw conveyor based on the current load of said electric motor and the pressure in said screw conveyor indicated by said pressure indicator.

10. The dust discharging system of claim 1, further comprising:

an auxiliary indicator that has a gas-filter bag connected fluidly to said airtight tank, said airtight tank being connected to said dust collector in a gas-tight relationship, said gas-filter bag being expandable when the flue dust from said dust collector flows into said airtight tank.

* * * * *